US009340049B2

(12) United States Patent
Hayashi

(10) Patent No.: US 9,340,049 B2
(45) Date of Patent: May 17, 2016

(54) MULTIPLE-CONDUCTOR FLAT CABLE

(71) Applicant: Ryuichi Hayashi, Ibaraki (JP)

(72) Inventor: Ryuichi Hayashi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/207,379

(22) Filed: Mar. 12, 2014

(65) Prior Publication Data

US 2014/0262429 A1 Sep. 18, 2014

(30) Foreign Application Priority Data

Mar. 15, 2013 (JP) ..... 2013-053951

(51) Int. Cl.

| | |
|---|---|
| ***H01B 7/08*** | (2006.01) |
| ***H01B 7/02*** | (2006.01) |
| ***H01B 7/18*** | (2006.01) |
| ***B41J 29/393*** | (2006.01) |
| ***B41J 19/00*** | (2006.01) |

(52) U.S. Cl.

CPC ..... *B41J 29/393* (2013.01); *B41J 19/005* (2013.01)

(58) Field of Classification Search

CPC ..... H01B 7/0823; H01B 7/08; H01B 7/0807; H01B 7/0815; H01B 7/083; H01B 7/0838; H01B 7/0846; H01B 7/0853; H01B 7/0892

USPC ..... 174/117 F, 117 FF

See application file for complete search history.

(56) References Cited

U.S. PATENT DOCUMENTS

| | | | | | |
|---|---|---|---|---|---|
| 4,627,076 | A * | 12/1986 | Staal | H01B 11/00 | 375/257 |
| 5,053,583 | A * | 10/1991 | Miller et al. | 174/36 | |
| 5,057,646 | A * | 10/1991 | Nichols et al. | 174/36 | |
| 5,084,594 | A * | 1/1992 | Cady et al. | 174/36 | |
| 5,342,991 | A * | 8/1994 | Xu et al. | 174/117 R | |
| 5,428,187 | A * | 6/1995 | Crane et al. | 174/36 | |
| 5,834,698 | A * | 11/1998 | Izui et al. | 174/113 R | |
| 7,525,046 | B2 * | 4/2009 | Yang | 174/113 R | |
| 8,067,693 | B2 * | 11/2011 | Sun et al. | 174/117 F | |
| 8,587,953 | B2 * | 11/2013 | Brock et al. | 361/755 | |
| 2002/0003047 | A1 * | 1/2002 | Osornio | H01B 7/225 | 174/117 F |
| 2009/0306485 | A1 * | 12/2009 | Bell | 600/301 | |

FOREIGN PATENT DOCUMENTS

| | | |
|---|---|---|
| JP | 2000-059549 | 2/2000 |
| JP | 2003-124596 | 4/2003 |
| JP | 2004-122584 | 4/2004 |
| JP | 2006-106331 | 4/2006 |
| JP | 2001-330877 | 9/2006 |

* cited by examiner

*Primary Examiner* — Chau N Nguyen
*Assistant Examiner* — Roshn Varghese
(74) *Attorney, Agent, or Firm* — Duft Bornsen & Fettig LLP

(57) ABSTRACT

A multiple-conductor flat cable includes: an analog cable portion formed such that ground signal lines and analog signal lines are alternately arranged side by side across a signal transmission direction and each adjacent pair of the ground signal lines and the analog signal lines are joined while being electrically insulated from each other; and a digital cable portion joined with the analog cable portion while being placed adjacent to the digital cable portion and formed such that digital signal lines are arranged side by side across the signal transmission direction and each adjacent pair of the digital signal lines are joined while being electrically insulated from each other.

6 Claims, 7 Drawing Sheets

MULTIPLE-CONDUCTOR FLAT CABLE

CROSS-REFERENCE TO RELATED APPLICATIONS

The present application claims priority to and incorporates by reference the entire contents of Japanese Patent Application No. 2013-053951 filed in Japan on Mar. 15, 2013.

BACKGROUND OF THE INVENTION

1. Field of the Invention

The present invention relates generally to multiple-conductor flat cables.

2. Description of the Related Art

Electromagnetic wave noise (ElectroMagnetic Interference (EMI)) from electronic equipment such as a personal computer device can adversely affect other electronic equipment. Accordingly, the Voluntary Control council for Interference by Information Technology Equipment (VCCI) requires that each VCCI member be obliged to assure that the strength of the disturbance from his products is contained below VCCI specified level.

When a high-frequency digital signal is fed to an electronic circuit, which is an EMI source, EMI is radiated from a cable that connects circuit boards where the electronic circuit is provided because the cable serves as an antenna where the EMI originates. A measure for suppressing EMI on the electronic circuit can be implemented relatively easily because of technical progress in simulation technology. However, a level of EMI radiated from the cable varies greatly depending on a position and an arrangement of the cable on a real apparatus. For this reason, it is difficult to predict the level of EMI from the cable using simulation technology. Under the circumstances, currently, a measure for suppressing EMI from a cable is applied at a stage of mounting the cable on a real apparatus.

Meanwhile, a technique for suppressing EMI radiation by arranging a flat cable along a conductive member and fixing the conductive member to a casing metal member connected to ground (GND) is disclosed in Japanese Laid-open Patent Application No. 2004-122584.

A technique for suppressing EMI radiation from signal lines by providing a spiral partition wall as a guide and arranging a flat cable along the guide is disclosed in Japanese Patent No. 3849403.

A technique for suppressing EMI radiation by bending or curling a flat cable, rather than linearly arranging the flat cable, thereby avoiding a linear arrangement that increases a radiation noise level in a specific direction is disclosed in Japanese Laid-open Patent Application No. 2003-124596.

However, the technique disclosed in Japanese Laid-open Patent Application No. 2004-122584 is disadvantageous in that the need of arranging the flat cable along the casing metal member connected to GND imposes a limitation on a pathway of the flat cable. Furthermore, in the technique disclosed in Japanese Laid-open Patent Application No. 2004-122584, one unit is made up of a single flat cable and a single conductive member. Accordingly, when applied to electronic equipment having a plurality of flat cables, this technique is disadvantageous in that a limitation is imposed on the implementation space in the electronic equipment.

The technique disclosed in Japanese Patent No. 3849403 is disadvantageous in that addition of the partition wall guide increases cost. The technique disclosed in Japanese Laid-open Patent Application No. 2003-124596 is disadvantageous in that bending or curling the flat cable increases the length of the cable, leading to an increase in impedance.

There is a need to provide a multiple-conductor flat cable that effectively suppresses EMI.

SUMMARY OF THE INVENTION

It is an object of the present invention to at least partially solve the problems in the conventional technology.

A multiple-conductor flat cable includes: an analog cable portion formed such that ground signal lines and analog signal lines are alternately arranged side by side across a signal transmission direction and each adjacent pair of the ground signal lines and the analog signal lines are joined while being electrically insulated from each other; and a digital cable portion joined with the analog cable portion while being placed adjacent to the digital cable portion and formed such that digital signal lines are arranged side by side across the signal transmission direction and each adjacent pair of the digital signal lines are joined while being electrically insulated from each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of multiple-conductor flat cables and a method for suppressing electromagnetic wave noise are described in detail below with reference to the accompanying drawings.

Overview

The multiple-conductor flat cable according to the embodiments suppresses EMI radiated in transmission of high-frequency digital signals as follows. That is, in the multiple-conductor flat cable according to the embodiments, a plurality of ground signal lines and a plurality of analog signal lines are arranged side by side across a signal transmission direction. An analog cable portion is formed such that each adjacent pair of the ground signal line and the analog signal line are joined while being electrically insulated from each other. A plurality of digital signal lines are arranged side by side across the signal transmission direction. A digital cable portion is formed such that each adjacent pair of the digital signal lines are joined while being electrically insulated from each other. The multiple-conductor flat cable is formed such that the analog cable portion and the digital cable portion are placed adjacent to each other and joined.

Further, in the multiple-conductor flat cable according to the embodiments, the analog cable portion is rolled up so as to wrap the digital cable portion that is rolled up in a direction across the signal transmission direction, with the digital cable portion placed inside. Alternatively, in the multiple-conductor flat cable according to the embodiments, the analog cable portion is folded in the direction across the signal transmission direction so as to cover the digital cable portion that is folded in a direction across the signal transmission direction, with the digital cable portion placed inside. As a result, the multiple-conductor flat cable according to the embodiments can cause electromagnetic wave noise, from the digital cable portion placed inside the multiple-conductor flat cable, to be suppressed by the analog cable portion. More specifically, the multiple-conductor flat cable according to the embodiments can cause the ground signal lines of the analog cable portion of the multiple-conductor flat cable to function as a shield, thereby suppressing electromagnetic wave noise from the digital cable portion.

First Embodiment

Figure 1:
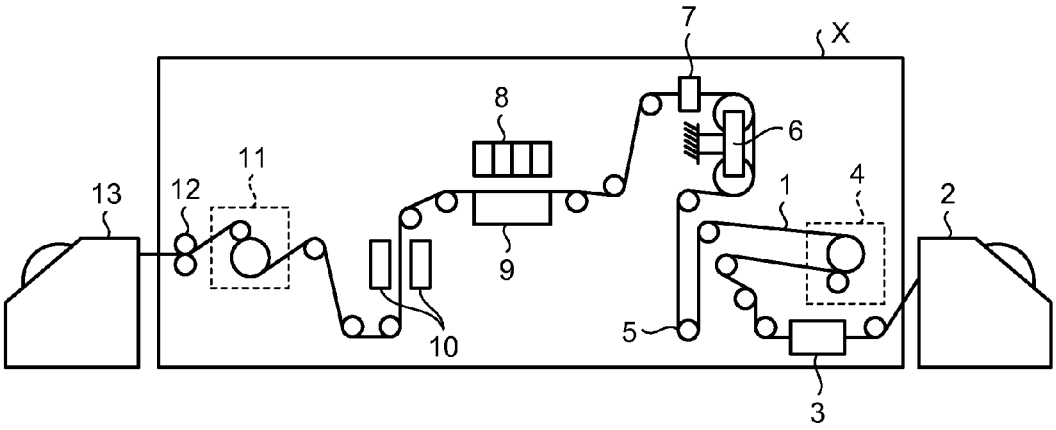
FIG. 1 is a schematic diagram for explaining an overall configuration of an on-demand line-scan inkjet recording apparatus provide with multiple-conductor flat cables according to an embodiment.

First, FIG. 1 is a schematic diagram for explaining an overall configuration of an on-demand line-scan inkjet recording apparatus provide with multiple-conductor flat cables according to the embodiment. As shown in FIG. 1, the inkjet recording apparatus includes a body X, a recording-medium supplying unit 2, and a recording-medium collecting unit 13.

The body X includes a recording medium 1, a regulating guide 3 that positions the recording medium 1 in a width direction, an in-feed unit 4 made up of a driving roller and a driven roller that hold the recording medium 1 under a constant tension, and a dancer roller 5 that moves up or down responsive to a tension in the recording medium 1 and outputs a position signal. Further, the body X includes an edge position controller (EPC) 6, and a slack amount detector 7, an inkjet recording head 8, a platen 9 arranged to face the inkjet recording head 8, and a drying unit 10. Further, the body X includes an out-feed unit 11 and a puller 12. The out-feed unit 11 made up of a driving roller and a driven roller drives the recording medium 1 at a set velocity. The puller 12 made up of a driving roller and a driven roller delivers the recording medium 1 to the exterior of the body X.

The inkjet recording head 8 includes a line head in which printing nozzles are arranged across an entire printing width. Color printing is performed by a line head for black, that for cyan, that for magenta, and that for yellow. Each of the line heads is supported so that a nozzle surface has a predetermined clearance above the platen 9. The inkjet recording head 8 ejects ink according to a conveyance velocity of the recording medium 1, thereby forming a color image on the recording medium 1.

Figure 2:
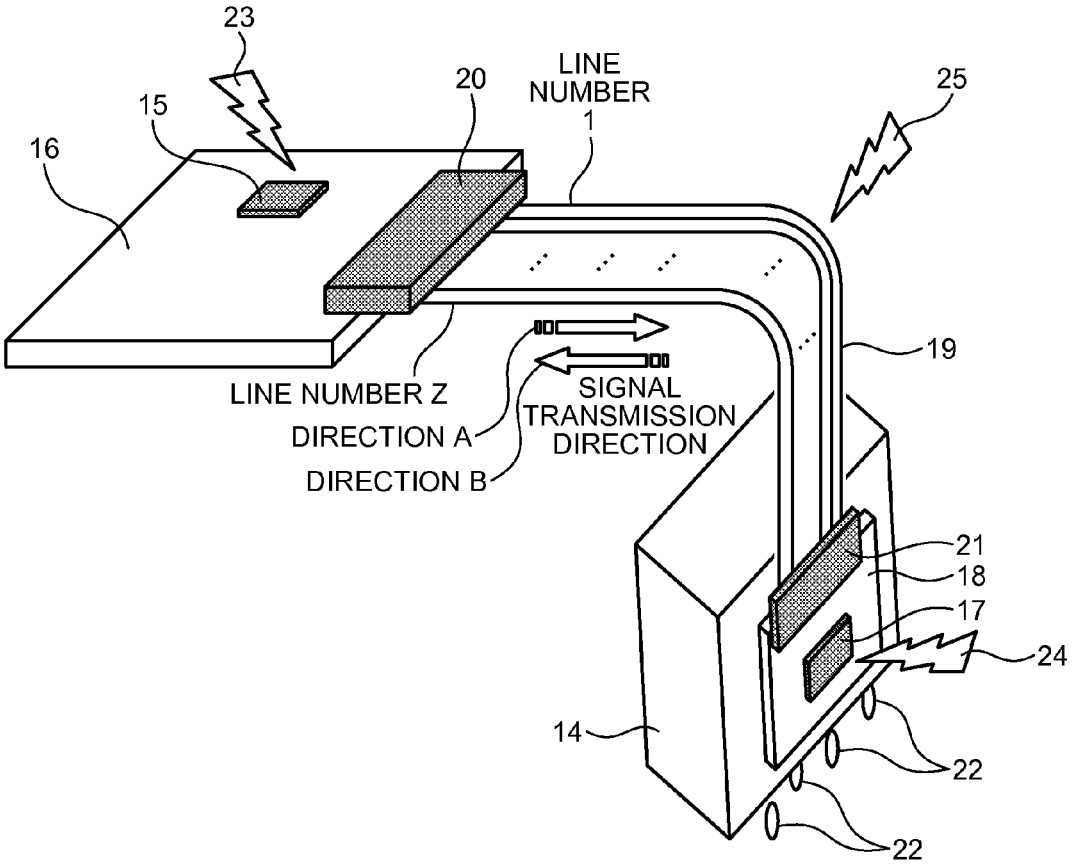
FIG. 2 is a schematic configuration diagram of an inkjet recording head.

FIG. 2 is the schematic configuration diagram of the inkjet recording head 8. In FIG. 2, the inkjet recording head 8 includes a recording head body 14 and a control circuit board 18 provided with a control integrated circuit (IC) 17 and provided on the recording head body 14. Further, the inkjet recording head 8 includes a host circuit board 16 provided with a drive IC 15 that supplies image data to the control circuit board 18, and a connector 21 of the control circuit board 18. Further, the inkjet recording head 8 includes a connector 20 of the host circuit board 16, and a multiple-conductor flat cable 19 according to the embodiment that transmits signals between the circuit boards.

The inkjet recording head 8 described above ejects ink 22 to form an image by controlling piezoelectric elements in the recording head body 14 by the control circuit board 18 according to the image data from the host circuit board 16. Transmitting signals viewed from the drive IC 15 are transmitted in a direction A and receiving signals are transmitted in a direction B as viewed from the drive IC 15. At this time, electromagnetic wave noise (EMI) 23 is radiated from the drive IC 15, EMI 24 is radiated from the control IC 17, and EMI 25 is radiated from the multiple-conductor flat cable 19 according to the frequency of respective high-frequency digital signals.

Figure 3:
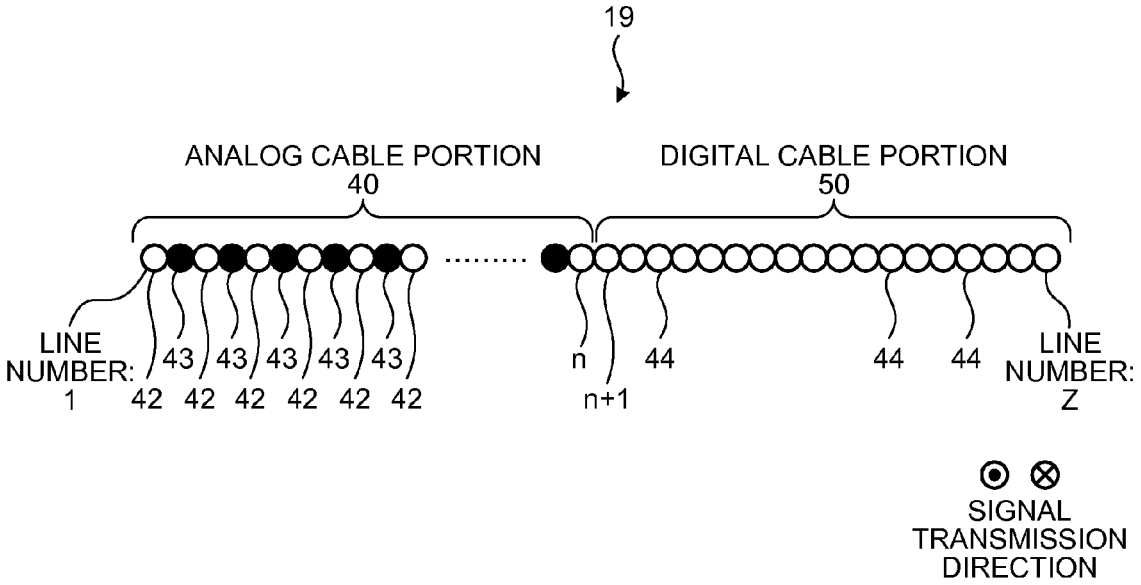
FIG. 3 is a cross-sectional view of a multiple-conductor flat cable according to a first embodiment.

FIG. 3 illustrates a cross-sectional view of the multiple-conductor flat cable 19. FIG. 3 is a diagram of a cross section of the multiple-conductor flat cable 19 as viewed from the connector 20 of the host circuit board 16. As seen from FIG. 3, the multiple-conductor flat cable 19 includes a plurality of signal lines with line numbers 1 to Z ($Z \geq 2$). The signal lines are arranged side by side across a signal transmission direction, and each adjacent pair of the signal lines is joined while being electrically insulated from each other. The multiple-conductor flat cable 19 is made of an analog cable portion 40 (line number: 1 to n (n is a natural number equal to or greater than 2)) and a digital cable portion 50 (line number: n+1 to Z).

The analog cable portion 40 is used in transmission of driving signals and as grounding conductors, for example. In the analog cable portion 40, analog signal lines 42 and ground signal lines 43 are alternately arranged to prevent crosstalk between analog signals, such as the driving signals. More specifically, in the analog cable portion 40, the analog signal lines 42 and the ground signal lines 43 are adjacently arranged side by side across the signal transmission direction. The analog cable portion 40 is formed such that each adjacent pair of the analog signal lines 42 and the ground signal lines 43 are joined while being electrically insulated from each other.

The digital cable portion 50 is used in transmission of high-frequency digital signals such as print data and clock signals. The digital cable portion 50 is formed such that digital signal lines 44 are arranged side by side across the signal transmission direction, and each adjacent pair of the digital signal lines 44 are joined while being electrically insulated from each other. In the multiple-conductor flat cable 19, the analog cable portion 40 and the digital cable portion 50 are arranged adjacent to each other. In this state, a line with a line number n among the signal lines 42 (or the ground lines 43) of the analog cable portion 40 is adjacent to a line with a line number n+1 among the digital signal lines 44 of the digital cable portion 50. The multiple-conductor flat cable 19 is formed such that the one line 42 or 43 with a line number n and the one digital signal line 44 with a line number n+1 are joined while being electrically insulated from each other.

Figure 4:
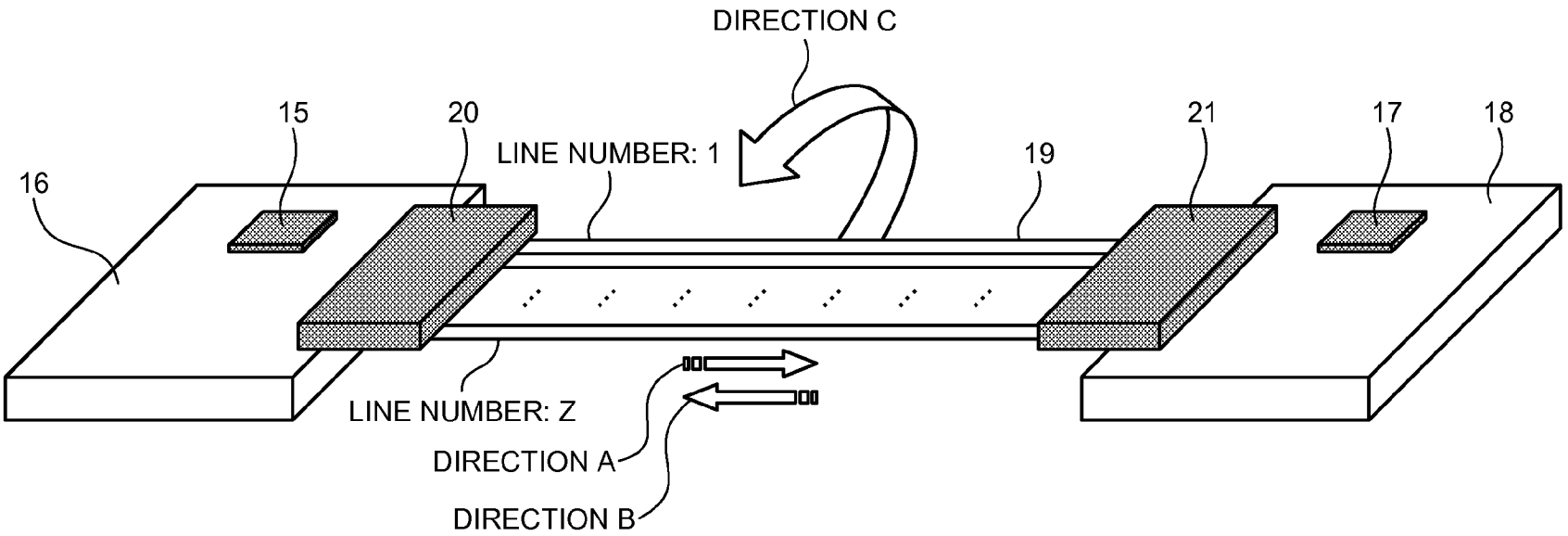
FIG. 4 is a diagram illustrating a roll-up direction of the multiple-conductor flat cable.

FIG. 4 is a diagram illustrating a roll-up direction of the multiple-conductor flat cable 19. The multiple-conductor flat cable 19 according to the first embodiment is rolled up about a roll-up axis that lies in a signal sending direction (direction A) and a signal receiving direction (direction B). The multiple-conductor flat cable 19 is formed such that the cable portions 40 and 50 are rolled up in a direction C with the analog signal line 42 of the analog cable portion 40 with a line number 1 placed outside. In other words, the multiple-conductor flat cable 19 is formed such that the digital cable portion 50 is rolled up inside and the analog cable portion 40 is rolled up so as to externally wrap the digital cable portion 50.

Figure 5:
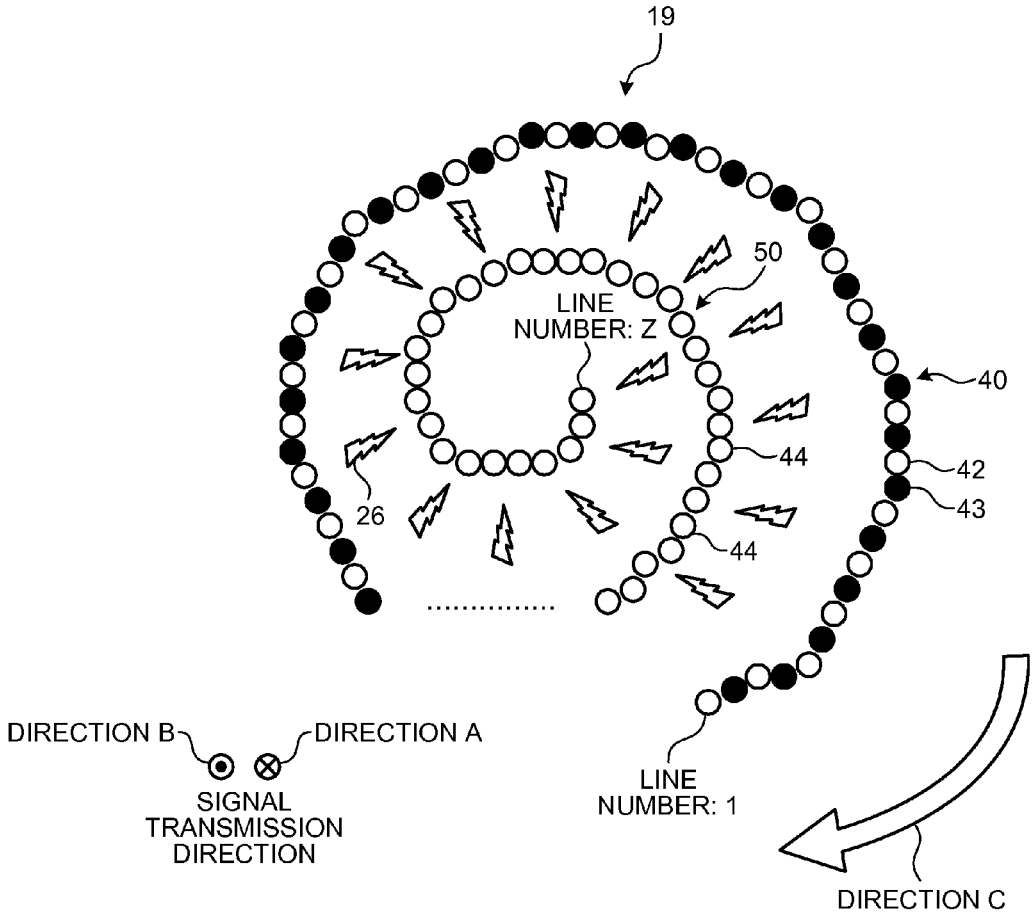
FIG. 5 is a cross-sectional view of the rolled-up multiple-conductor flat cable according to the first embodiment.

FIG. 5 illustrates a cross-sectional view of the multiple-conductor flat cable 19 that is rolled up. FIG. 5 is a diagram of the multiple-conductor flat cable 19 as viewed from the connector 20 of the host circuit board 16. As illustrated in FIG. 12, the multiple-conductor flat cable 19 is formed such that the analog cable portion 40 is rolled up so as to externally wrap the digital cable portion 50 that is rolled up inside. This allows EMI 26 radiated from the digital cable portion 50 that transmits high-frequency digital signals, to be absorbed by the ground signal lines 43 of the analog cable portion 40. Consequently, a disadvantageous situation that the digital cable portion 50 radiates the EMI 26 to the outside can be prevented.

The assignee of the present invention manufactured the multiple-conductor flat cable 19 described above and supplied high-frequency digital signals in a frequency band of 100 to 200 MHz to the digital cable portion 50. As a result, EMI suppression of approximately −5 decibels was obtained with the rolled-up multiple-conductor flat cable 19 compared with a multiple-conductor flat cable that is not rolled up.

Figure 6:
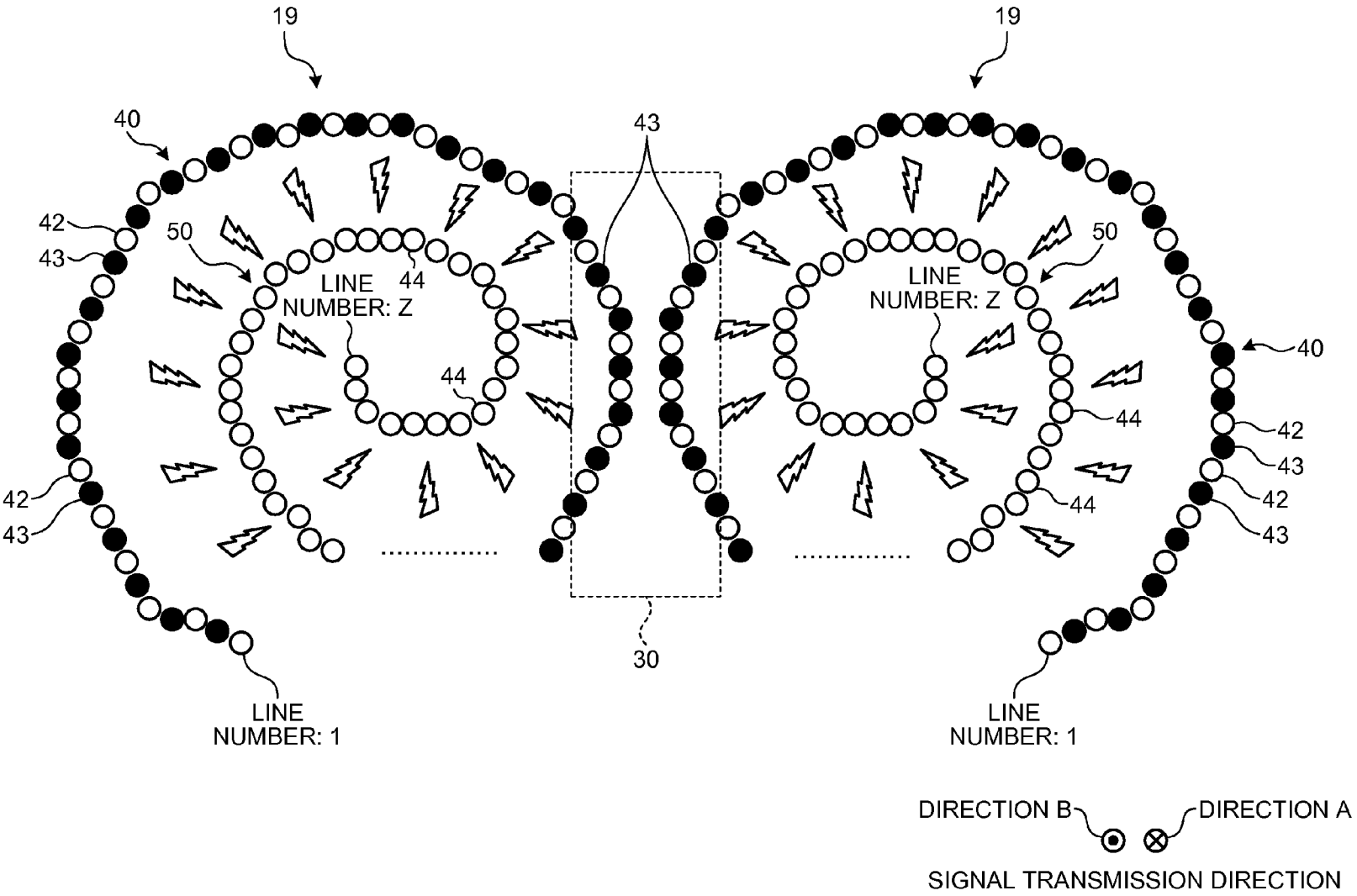
FIG. 6 is a cross-sectional view of two rolled-up multiple-conductor flat cables arranged adjacent to each other according to the first embodiment.

FIG. 6 is a cross-sectional view of the two rolled-up multiple-conductor flat cables 19 that are arranged adjacent to each other. Each one of the multiple-conductor flat cables 19 corresponds to a single multiple-conductor flat cable piece. As illustrated in FIG. 6, when a plurality of the multiple-conductor flat cables 19 are arranged adjacent to each other, the following effect can be obtained at a contact area 30 where the multiple-conductor flat cables 19 contact each other. That is, even if electromagnetic wave noise leaks from the analog cable portion 40 placed outside, the electromagnetic wave noise can be absorbed by the ground signal lines 43 of the analog cable portion 40 of the other multiple-conductor flat cable 19 that is adjacent thereto. Consequently, further EMI suppression effect can be obtained. In such an on-demand line-scan inkjet recording apparatus as that illustrated in FIG. 1, it is typical that a plurality of the multiple-conductor flat cables 19 are included in the apparatus. Therefore, EMI can be suppressed more effectively by arranging the plurality of multiple-conductor flat cables 19 adjacent to each other as described above with reference to FIG. 14.

Figure 7:
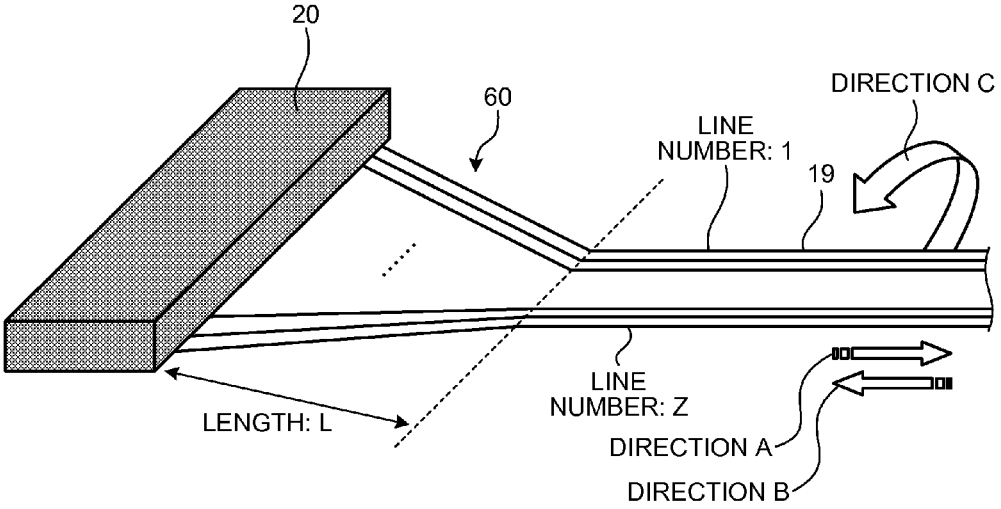
FIG. 7 is a diagram illustrating a portion where a connector and the multiple-conductor flat cable according to the first embodiment are connected.

FIG. 7 illustrates a portion where the connector 20 and the multiple-conductor flat cable 19 are connected. It is difficult to form the multiple-conductor flat cable 19 into the rolled-up form near the connector 20. For this reason, the multiple-conductor flat cable 19 according to the first embodiment includes a length-L portion, which extends from the connector 20 over a length L, where the lines are physically separated from one another.

In other words, this length-L portion is a separate line portion 60. The lines in the separate line portion 60 are physically separated from one another. For example, in the multiple-conductor flat cable 19, a portion of the cable 19 within several centimeters to ten and several centimeters from the connector 20 is formed as the separate line portion 60. Configuring the multiple-conductor flat cable 19 to include the separate line portion 60 allows effective reduction of the EMI by forming the multiple-conductor flat cable 19, excluding the separate line portion 60, into the rolled-up form while making it possible to easily and securely fixe the lines to the connector 20.

As will be apparent from the above description, in the multiple-conductor flat cable 19 according to the first embodiment, the analog signal lines 42 and the ground signal lines 43 are alternately arranged side by side across the signal transmission direction. Further, in the multiple-conductor flat cable 19, the analog cable portion 40 is formed such that each adjacent pair of the analog signal line 42 and the ground signal line 43 are joined while being electrically insulated from each other. Further, in the multiple-conductor flat cable 19, the digital cable portion 50 is formed such that the digital signal lines 44 are arranged side by side across the signal transmission direction, and each adjacent pair of the digital signal lines 44 are joined while being electrically insulated from each other. Further, in the multiple-conductor flat cable 19, the analog cable portion 40 and the digital cable portion 50 are arranged adjacent to each other, and the line with the line number n among the analog signal lines 42 and the line with the line number n+1 among the digital signal lines 44 that are adjacent to each other are joined. Then, the conductor flat cable 19 is formed such that the digital cable portion 50 is rolled up inside and the analog cable portion 40 is rolled up so as to externally wrap the digital cable portion 50.

This causes the ground signal lines 43 of the analog cable portion 40 to function as a shield, thereby allowing the EMI (electromagnetic wave noise) radiated from the digital cable portion 50, to be absorbed by the ground signal lines 43. Consequently, a disadvantageous situation that the EMI radiated from the digital cable portion 50 is emitted to the outside can be prevented.

Furthermore, because it is unnecessary to arrange the multiple-conductor flat cable 19 along a casing metal member in electronic equipment, no limitation is imposed on a pathway of the multiple-conductor flat cable 19. Accordingly, it becomes possible to arrange the multiple-conductor flat cable 19 at a desired location. Furthermore, even when a plurality of multiple-conductor flat cables 19 are to be used, it is unnecessary to provide a plurality of casing metal members. Accordingly, a disadvantageous situation that much space is dedicated to the plurality of multiple-conductor flat cables 19 in electronic equipment can be prevented.

Furthermore, this configuration can be implemented less expensively because it is unnecessary to provide a spiral partition wall. Furthermore, because the multiple-conductor flat cable 19 is not bent in the signal transmission direction, the cable does not increase in length. Consequently, a disadvantageous increase in impedance, which would otherwise occur if the multiple-conductor flat cable 19 was bent in the signal transmission direction, can be prevented.

As described above, in the multiple-conductor flat cable 19 according to the first embodiment, no limitation is imposed on a pathway of the multiple-conductor flat cable 19. Accordingly, a disadvantageous situation that much space is dedicated to the multiple-conductor flat cable(s) 19 in the electronic equipment is prevented. The multiple-conductor flat cable 19 can effectively suppress the EMI radiated from the digital cable portion 50 without requiring an additional member and without increasing cable impedance.

Furthermore, in the multiple-conductor flat cables 19 according to the first embodiment, a plurality of the multiple-conductor flat cables 19 are arranged adjacent to each other. This allows the EMI leaked from one of the multiple-conductor flat cables 19 to be absorbed by the ground signal lines 43 of the analog cable portion 40 of the other one of the multiple-conductor flat cables 19, and thereby a further EMI suppression effect can be obtained.

Second Embodiment

A multiple-conductor flat cable according to a second embodiment is described below. The multiple-conductor flat cable 19 according to the first embodiment is formed such that the multiple-conductor flat cable 19 is rolled up with the analog cable portion 40 placed inside and with the digital cable portion 50 placed outside. In contrast, a multiple-conductor flat cable according to the second embodiment is formed such that the multiple-conductor flat cable is folded in such a manner that the analog cable portion externally covers the digital cable portion.

Figure 8:
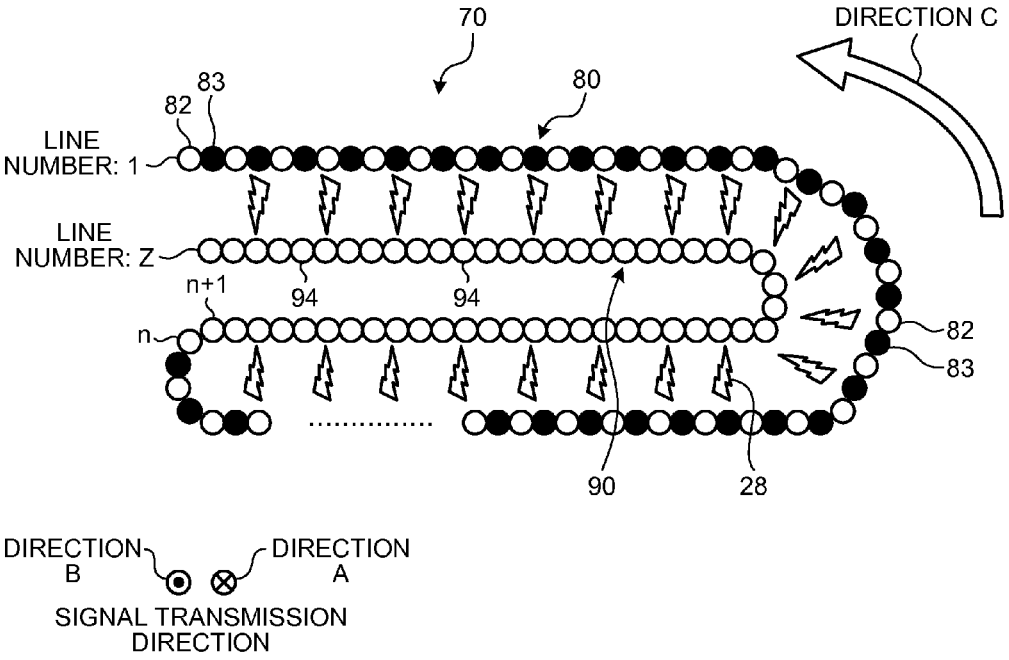
FIG. 8 is a cross-sectional view of a multiple-conductor flat cable according to a second embodiment.

FIG. 8 is a cross-sectional view of a multiple-conductor flat cable 70 according to the second embodiment. FIG. 8 is a diagram of a cross section of the multiple-conductor flat cable 70 as viewed from the connector 20 of the host circuit board 16. As seen from FIG. 8, the multiple-conductor flat cable 70 includes a plurality of signal lines with line numbers 1 to Z (Z≥2). The signal lines are arranged side by side across a signal transmission direction, and each adjacent pair of the signal lines is joined while being electrically insulated from each other. The multiple-conductor flat cable 70 is made of an analog cable portion 80 (line number: 1 to n (n is a natural number equal to or greater than 2)) and a digital cable portion 90 (line number: n+1 to Z).

The analog cable portion 80 is used in transmission of driving signals and as grounding conductors, for example. In the analog cable portion 80, analog signal lines 82 and ground signal lines 83 are alternately arranged to prevent crosstalk between analog signals, such as the driving signals. More specifically, in the analog cable portion 80, the analog signal lines 82 and the ground signal lines 83 are adjacently arranged side by side across the signal transmission direction. The analog cable portion 80 is formed such that each adjacent pair of the analog signal lines 82 and the ground signal lines 83 are joined while being electrically insulated from each other.

The digital cable portion 90 is used in transmission of high-frequency digital signals such as print data and clock signals. The digital cable portion 90 is formed such that digital signal lines 94 are arranged side by side across the signal transmission direction and each adjacent pair of the digital signal lines 94 are joined while being electrically insulated from each other. In the multiple-conductor flat cable 70, the analog cable portion 80 and the digital cable portion 90 are arranged adjacent to each other. In this state, a line with a line number n among the signal lines of the analog cable portion 80 is adjacent to a line with a line number n+1 among the digital signal lines of the digital cable portion 90. The multiple-conductor flat cable 70 is formed such that the one signal line with a line number n and the one digital signal line with a line number n+1 are joined while being electrically insulated from each other.

Referring to FIG. 8, the multiple-conductor flat cable 70 according to the second embodiment is formed as follows. The digital cable portion 90 is folded in half in the direction C that is perpendicular to the signal sending direction (direction A) and the signal receiving direction (direction B). The analog cable portion 80 is folded so as to cover the folded digital cable portion 90. Consequently, the multiple-conductor flat cable 70 is formed such that the digital cable portion 90 folded in half is covered by the analog cable portion 80 that is folded in half.

The multiple-conductor flat cable 70 according to the second embodiment described above can cause EMI 28 radiated from the digital cable portion 90 that transmits high-frequency digital signals, to be absorbed by the ground signal lines 83 of the analog cable portion 80. Consequently, a disadvantageous situation that the digital cable portion 90 radiates the EMI 28 to the outside can be prevented.

Figure 9:
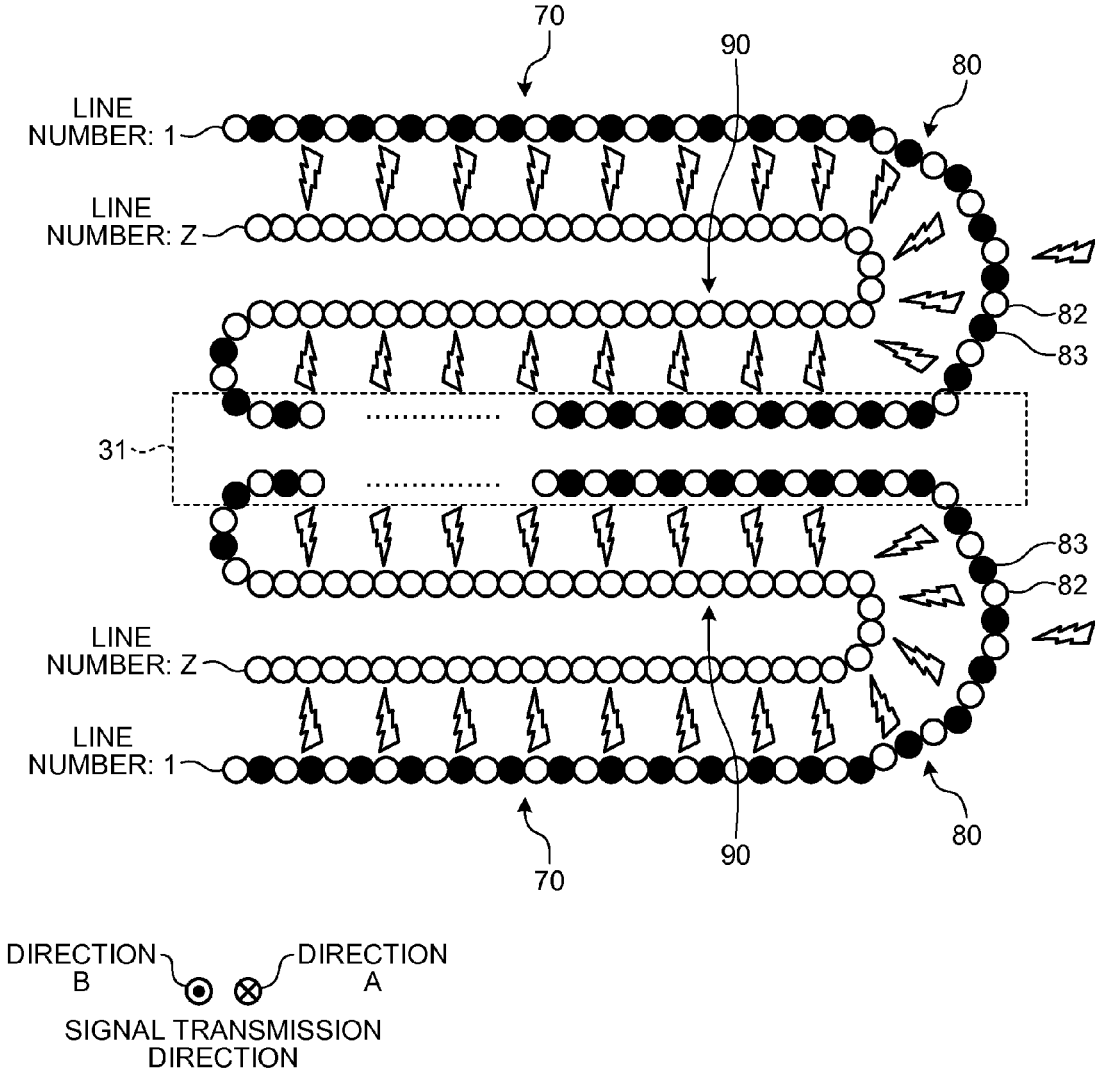
FIG. 9 is a cross-sectional view of two folded multiple-conductor flat cables arranged adjacent to each other according to the second embodiment.

FIG. 9 is a cross-sectional view of the two folded multiple-conductor flat cables 70 that are arranged adjacent to each other. Each one of the multiple-conductor flat cables 70 corresponds to a single multiple-conductor flat cable piece. As illustrated in FIG. 9, when a plurality of the multiple-conductor flat cables 70 are arranged adjacent to each other, the following effect can be obtained at a contact area 95 where the multiple-conductor flat cables 70 contact each other. That is, even if electromagnetic wave noise leaks from the analog cable portion 80 placed outside, the electromagnetic wave noise can be absorbed by the ground signal lines 83 of the analog cable portion 80 of the other multiple-conductor flat cable 79 that is adjacent thereto. Consequently, further EMI suppression effect can be obtained. In such an on-demand line-scan inkjet recording apparatus as that illustrated in FIG. 1, it is typical that a plurality of the multiple-conductor flat cables 70 are included in the apparatus. Therefore, EMI can be suppressed more effectively by arranging the plurality of multiple-conductor flat cables 70 adjacent to each other as described above with reference to FIG. 9.

The multiple-conductor flat cable 70 of the second embodiment includes the separate line portion 60, which extends from the connector 20 over the length L, where the lines are physically separated from each other as does the multiple-conductor flat cable 19 described above with reference to FIG. 7.

As will be apparent from the above description, in the multiple-conductor flat cable 70 according to the second embodiment, the digital cable portion 90 is folded in half in the direction C perpendicular to the signal sending direction (direction A) and the signal receiving direction (direction B). The analog cable portion 80 is folded so as to cover the folded digital cable portion 90. In short, the multiple-conductor flat cable 70 of the second embodiment is formed such that the digital cable portion 90 folded in half is covered by the analog cable portion 80 that is folded in half.

Because the multiple-conductor flat cable 70 according to the second embodiment is configured as described above, the EMI 28 radiated from the digital cable portion 90 that transmits high-frequency digital signals can be absorbed by the ground signal lines 83 of the analog cable portion 80. Accordingly, the second embodiment can yield effects, similar to those of the first embodiment, including preventing a disadvantageous situation that the digital cable portion 90 radiates the EMI 28 to the outside.

In the multiple-conductor flat cables 70 according to the second embodiment, the plurality of multiple-conductor flat cables 70 are arranged adjacent to each other. This arrangement allows EMI leaked from one of an adjacent pair of the multiple-conductor flat cables 70 to be absorbed by the ground signal lines 83 of the analog cable portion 80 of the other one of the adjacent pair of the multiple-conductor flat cables 70. Accordingly, not only effects similar to those of the above embodiments can be obtained but also a further EMI suppression effect can be obtained.

According to the embodiment, EMI can be effectively suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A multiple-conductor flat cable comprising:

an analog cable portion formed such that ground signal lines and analog signal lines are alternately arranged side by side across a signal transmission direction and each adjacent pair of the ground signal lines and the analog signal lines are joined while being electrically insulated from each other; and a digital cable portion joined with the analog cable portion while being placed adjacent to the digital cable portion and formed such that digital signal lines are arranged side by side across the signal transmission direction and each adjacent pair of the digital signal lines are joined while being electrically insulated from each other, wherein the digital cable portion is placed inside the analog cable portion, and the analog cable portion surrounds the digital cable portion from every direction or almost every direction.

2. The multiple-conductor flat cable according to claim 1, wherein the multiple-conductor flat cable is formed such that the analog cable portion is rolled up so as to wrap the digital cable portion that is rolled up in a direction across the signal transmission direction.

3. The multiple-conductor flat cable according to claim 2, wherein the multiple-conductor flat cable includes a plurality of multiple-conductor flat cable pieces, each of which is formed such that the analog cable portion is rolled up so as to wrap the digital cable portion that is rolled up in the direction across the signal transmission direction, with the digital cable portion placed inside, and the plurality of multiple-conductor flat cable pieces are adjacent to each other.

4. The multiple-conductor flat cable according to claim 1, wherein the multiple-conductor flat cable is formed such that the digital cable portion is folded in a direction across the signal transmission direction and the analog cable portion is folded in a direction across the signal transmission direction so as to cover the digital cable portion that is folded in the direction across the signal transmission direction.

5. The multiple-conductor flat cable according to claim 4, wherein the multiple-conductor flat cable includes a plurality of multiple-conductor flat cable pieces, each of which is formed such that the analog cable portion is folded in the direction across the signal transmission direction so as to cover the digital cable portion that is folded in the direction across the signal transmission direction, with the digital cable portion placed inside, and the plurality of multiple-conductor flat cable pieces are adjacent to each other.

6. The multiple-conductor flat cable according to claim 1, wherein the ground signal lines and the analog signal lines of the analog cable portion are physically separated from one another near a connector, and the digital signal lines of the digital cable portion are physically separated from one another near the connector.

* * * * *